US008261723B2

(12) United States Patent
Parks

(10) Patent No.: US 8,261,723 B2
(45) Date of Patent: Sep. 11, 2012

(54) FUEL RETURN BLOCK

(76) Inventor: Gary L Parks, Creal Springs, IL (US)

( * ) Notice: Subject to any disclaimer, the term of this patent is extended or adjusted under 35 U.S.C. 154(b) by 248 days.

(21) Appl. No.: 12/857,833

(22) Filed: Aug. 17, 2010

(65) Prior Publication Data

US 2011/0041938 A1 Feb. 24, 2011

Related U.S. Application Data

(60) Provisional application No. 61/234,693, filed on Aug. 18, 2009.

(51) Int. Cl.
*F02M 37/00* (2006.01)

(52) U.S. Cl. ..... 123/514; 137/583; 137/588

(58) Field of Classification Search ..... 137/583, 137/588; 123/514, 509
See application file for complete search history.

(56) References Cited

U.S. PATENT DOCUMENTS 4,502,450 A * 3/1985 Duprez ..... 123/516
4,617,116 A * 10/1986 Seiler ..... 210/137
5,062,444 A * 11/1991 Bergsma ..... 137/202
5,471,964 A * 12/1995 Hurner ..... 123/514
5,533,486 A * 7/1996 Qutub ..... 123/541
6,113,354 A * 9/2000 Meese et al. ..... 417/199.1
6,575,193 B2 * 6/2003 Chang et al. ..... 137/558
6,845,782 B2 * 1/2005 Osterkil et al. ..... 137/1
6,981,491 B2 * 1/2006 Schmitt et al. ..... 123/514
7,318,414 B2 * 1/2008 Hou ..... 123/458
7,493,893 B2 * 2/2009 Funabashi et al. ..... 123/497
2005/0092304 A1 * 5/2005 Jin ..... 123/514
2005/0166902 A1 * 8/2005 Schmitt et al. ..... 123/514
2006/0037587 A1 * 2/2006 Mc Clure et al. ..... 123/509

* cited by examiner

*Primary Examiner* — John Rivell
*Assistant Examiner* — Minh Le
(74) *Attorney, Agent, or Firm* — Charles McCloskey

(57) ABSTRACT

A fuel return block has a body with a coaxial inlet and outlet generally perpendicular to the body, a return port communicating with an inlet, and a vent generally parallel to the inlet and the outlet while communicating with the return port. The inlet and the outlet have external threading for connection to a fuel tank and to a fuel line. A common space between the inlet, the outlet, the return port, and the vent has a particular geometry conducive to ventilation of the fuel return block but not allowing escape of fuel through the vent. The inlet secures to a manufacturer's fitting upon the fuel tank so no second opening is required. The fuel return block equalizes pressures of the inlet, the outlet, and the return port preventing tank damage and interruptions to fuel delivery from negative pressure.

12 Claims, 2 Drawing Sheets

FUEL RETURN BLOCK

CROSS-REFERENCE TO RELATED PATENTS

This non-provisional application claims priority to the provisional application 61/234,693 filed on Aug. 19, 2009 which is owned by the same inventor.

BACKGROUND OF THE INVENTION

The fuel return block generally relates to diesel fuel systems and more specifically to returning diesel fuel to a tank through a common aperture in the tank. The invention relates to the safe withdrawal and return of diesel fuel from tanks upon vehicles and other equipment.

After wagons, transportation companies developed trucks in the last century. Trucks and related vehicles have had various power plants over the decades. In recent decades, diesel engines have become the dominant power source for trucks and related vehicles. The diesel engine has a limited ignition system in comparison to a gasoline engine that has a spark plug on each cylinder to ignite the fuel air mixture for each piston stroke. The diesel engine may have one glow plug that warms diesel fuel for the initial start of the engine. After starting, the diesel engine has a proportionate amount of fuel vaporized and delivered to each cylinder. Each stroke of a piston compresses the diesel fuel vapor in the cylinder until combustion occurs at the top of the piston stroke.

During operations of a truck, the diesel engine runs continuously until stopped by the operator. The continuous operations require a constant flow of fuel from a tank upon the truck. A truck V has a tank T shown adjacent to the chassis ahead of the drive wheels in FIG. 1. Though a tractor is shown, this description applies to other diesel engine powered vehicles. The fuel system of the truck pumps diesel fuel from the tank into the engine's fuel system for combustion. Unlike a gasoline engine that combusts the entire amount of fuel delivered to a cylinder, a diesel engine has fuel not combusted by the engine. The fuel system of the diesel engine continues from the engine back to the tank T. The fuel system returns diesel fuel to the tank under pressure but a different pressure than that of withdrawing fuel from the tank for delivery to the engine. At times, the difference in pressure between withdrawing fuel and returning fuel along with ambient atmospheric pressure leads to cavitations, hammering, or other pumping problems. The pressure difference may also impede venting of the tank causing a risky accumulation of diesel vapors.

DESCRIPTION OF THE PRIOR ART

Over the years, truckers and mechanics have sought safe return of diesel fuel to the tank on a vehicle. Generally, a fuel tank has one opening for removal of fuel as provided by the manufacturer. However, returning the fuel to the tank calls for another line from the engine's fuel system back to the tank. Prior art fuel return systems generally puncture a fuel tank with a second opening and connect the return line to the tank. FIG. 2 shows a prior art tank T with an opening O with a fitting F that leads to a fuel line L that delivers fuel to the engine. The fitting connects to a draw tube D extending towards the bottom of the interior of the tank and in communication to the fuel line. Fuel returns from the engine through a return line R that connects to a second fitting S upon a second opening P. As shown the opening O and the second opening P may be adjacent however, mechanics have discretion in locating the second opening. The second fitting leads to a small return tube Q that enters the tank but does not reach the bottom of the tank.

The prior art mechanically modifies a fuel tank for attaching the return fuel line. Performing the modifications requires considerable care and preventive efforts to avoid accidents in the presence of volatile petroleum fuels, whether liquid or vapor, and ignition sources such as a torch or punch.

The present invention overcomes the disadvantages of the prior art and provides a fuel return block that eliminates dangerous modifications to a fuel tank. The present invention also returns fuel safely to the fitting and into the tank while simultaneously venting the tank to accommodate pressure imbalances. The present invention withdraws fuel, returns fuel, and vents through the same fitting to the tank.

SUMMARY OF THE INVENTION

Generally, the fuel return block has a body with a coaxial inlet and outlet generally perpendicular to the body, a return port in communication with the inlet, and a vent generally parallel to the inlet and the outlet while in communication with the return port. The inlet and the outlet have external threading for connection to a fuel tank and to a fuel line. The inlet, the outlet, the return port, and the vent have a common communication space with a particular geometry conducive to ventilation of the fuel return block but not allowing escape of fuel through the vent. The inlet secures to the manufacturer's fitting upon the tank and thus no second opening is required.

The present invention prevents the accumulation of negative pressure, or partial vacuum, inside a diesel fuel tank which may damage the tank from crushing or stress fracturing and lead to leaks. Further the vent port of the invention allows entry of air into the fuel tank, equalizing pressure and diluting explosive vapors. The invention installs upon existing diesel fuel tanks with existing fittings at a nominal cost by a skilled mechanic.

There has thus been outlined, rather broadly, the more important features of the invention in order that the detailed description thereof that follows may be better understood and that the present contribution to the art may be better appreciated. The present invention also includes a conically shaped common space, and variations in inlet inside diameter and outlet inside diameter. Additional features of the invention will be described hereinafter and which will form the subject matter of the claims attached.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a fuel return block that withdraws fuel without causing negative pressure within a fuel tank.

Another object is to provide such a fuel return block that delivers sufficient diesel fuel to an operating engine and returns excess liquid fuel from the engine's fuel system to the fuel tank in a safe, non-explosive manner.

Another object is to provide such a fuel return block that provides air into the fuel tank to equalize pressures with minimal releasing of fuel vapors to the atmosphere.

Another object is to provide such a fuel return block that installs in an existing fuel tank fitting without modifying the fuel tank for a second fitting.

Another object is to provide such a fuel return block that has a low cost of manufacturing so the purchasing truckers, mechanics, and organizations can readily buy the fuel return block through stores and supply sources.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated and described a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
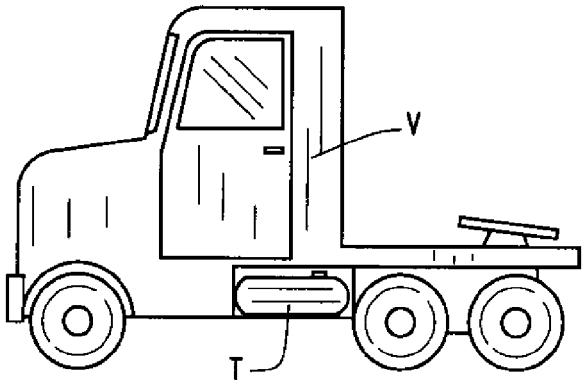
FIG. 1 shows a side view of a truck with a tank.
Figure 2:
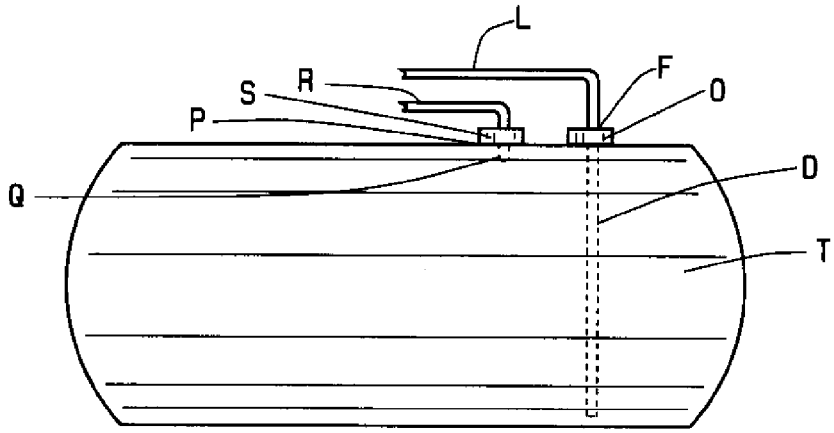
FIG. 2 PRIOR ART
FIG. 2 describes a side view of a prior art return line upon a fuel tank.
Figure 3:
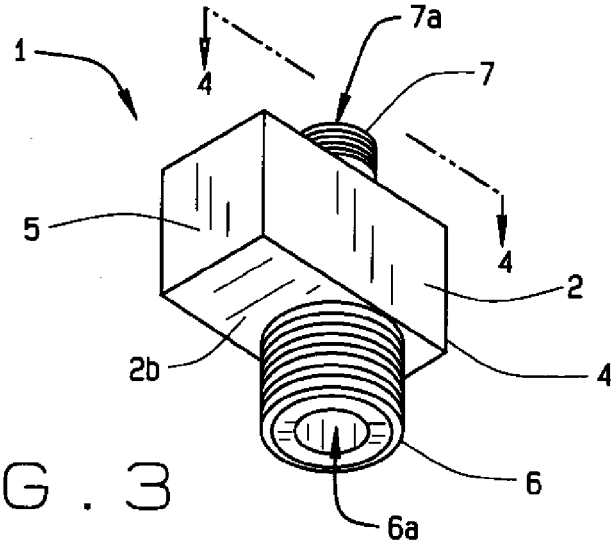
FIG. 3 provides a perspective view of the present invention.

The present art overcomes the prior art limitations by providing a previously described truck as shown in FIG. 1 that overcomes the dual opening shown in FIG. 2 with a fuel return block 1 shown in FIG. 3. The present invention has a body 2, generally elongated, with a length and longitudinal axis, here shown as a prismatic rectangular shape though a round body is also foreseen. The body has two opposite ends, a first end 4 and a second end 5 generally perpendicular to the length of the body. Towards the first end, the body has an inlet 6 extending downwardly generally perpendicular to the length of the body. The inlet generally has external threading complementary to the threading provided in the fuel tank opening O by the manufacturer. The inlet has a hollow chamber 6*a* with an inside diameter that receives a draw tube D as previously shown in FIG. 2. Opposite the inlet and also perpendicular to the body, the fuel return block has an outlet 7. The outlet also has external threading complementary to the threading of existing fuel lines L. The outlet is generally coaxial with the inlet but of a lesser outside and inside diameter. The outlet also has its hollow chamber as at 7*a*. The chambers of the outlet and the inlet need not have the same inside diameter.

Figure 4:
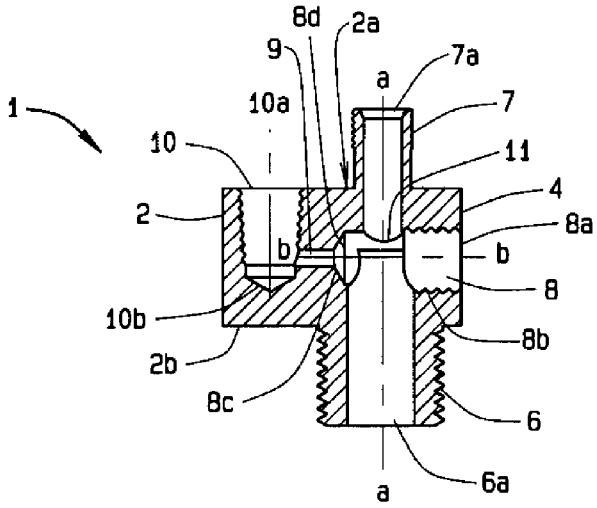
FIG. 4 shows a sectional view of the present invention.

Viewing the fuel return block in more detail with FIG. 4, the body has a return port 8 generally centered in the first end 4. The return port has a first diameter 8*a* proximate the first end 4 that admits a return fuel line L. The return port then constricts its diameter similar to a frusto conical shape proximate the intersection of the chamber 6*a* of the inlet and a second diameter 8*b* of the return port. Beyond the inlet, that is, towards the second end 5, the return port constricts to its third diameter as at 8*c*, generally smaller than the previous two diameters, 8*a*, 8*b*. The return port, generally hollow through its length inside the body 2, has a beveled end, as at 8*d*, positioned generally in the center of the body. The beveled end leads to a short tube 9 of much lesser diameter than the third diameter 8*c* of the return port and the short tube is parallel to the length of the body. The return port and the tube 9 are coaxial and centered on the length of the body. Towards the second end 5 of the body, the tube opens to a vent 10 that is generally perpendicular to the return port. The vent has a frusto conical shape that opens upon the body adjacent to the outlet 7. The vent is generally hollow with a sidewall into which the tube 9 opens. The vent opens at the surface of the body as at 10*a* and then narrows in diameter towards a beveled base 10*b*. The beveled base is generally below the center of the body and towards the inlet. The body towards the inlet is generally the bottom 2*b* of the invention and the body towards the outlet is generally the top 2*a* of the invention.

The vent allows minimal release of fuel vapors and ready entry of air through its opening as at 10*a* while retaining liquid fuel in its base 10*b*.

The inlet 6, the outlet 7, and the return port 8 intersect at a common space 11. The common space has an initial geometry similar to a truncated cone oriented upon the length of the body as on line bb. The common space 11 then has the conic shape broken by the intersections of the chambers 6*a*, 7*a*, of the inlet and outlet along line aa. These intersections partially deform the common space 11 so that the cone shape is smoothed across the diameters of the inlet and the outlet. The common space still functions in its prime task of passing fuel from the outlet through the inlet while receiving returned fuel from the return port.

The returned fuel then condenses upon a draw tube (not shown) inserted through the inlet's chamber into the common space. The draw tube (not shown) directs the returned fuel down its length into the tank for reuse. As the engine's fuel system withdraws and returns fuel, pressure between the inlet and the outlet can differ. The tube 9 allows for air, from the vent 10, to enter the common space 11 when the pressure difference between the outlet 7 and the inlet 6 dips below atmospheric pressure. However, the vent retains any fuel that exits the tube 9 within the base 10*b* during the opposite pressure situation where the pressure difference between the outlet and the inlet exceeds atmospheric pressure.

In an alternate embodiment, the outlet utilizes a threaded recess in the top 2*a* of the body. The outlet includes a compression seal where the chamber 7*a* intersects the common space 11 at its bottom, interiorly of the body.

Figure 5:
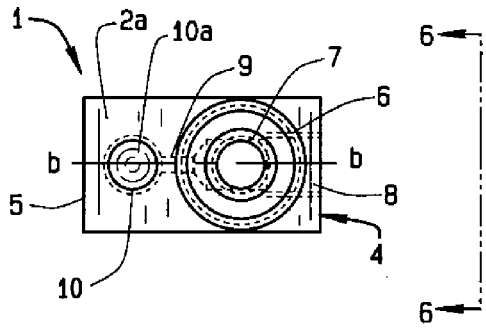
FIG. 5 illustrates a top view of the present invention with the outlet to the right; and, FIG. 6 shows an end view of the present invention through the return port.

Turning the fuel return block, FIG. 5 shows the top 2*a* of the body 2. The top extends from the second end 5 inwardly to the vent 10 with its opening 10*a*. Inwardly from the vent, the top has the outlet 7 generally above the inlet 6 shown in phantom. The return port 8, shown in phantom, enters the first end 4 of the body 2 below the top 2*a* but into both the inlet and the outlet. The return port narrows beneath the outlet and towards the second end and opens into the tube 9 shown in phantom. The tube 9 then opens into the sidewall of the vent 10.

Figure 6:
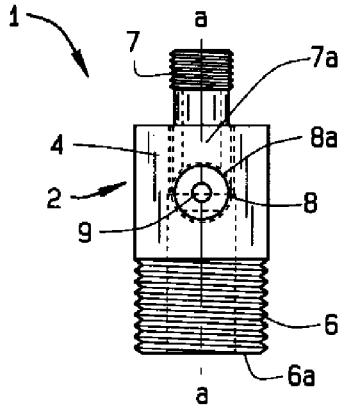

And, FIG. 6 shows the fuel return block from the first end 4. The first end has the return port 8 entering the body 2. The return port terminates away from the first end 4 in the tube 9 shown centered in the opening 8*a* of the return port 8. The tube 9 has a much less diameter than the return port, the inlet, and the outlet. The inlet extends perpendicular below the body with its chamber 6*a* communicating to the return port 8 through the common space 11. Opposite the inlet, the outlet extend perpendicular above the body with its chamber 7*a* also communicating to the common space. The fuel return block delivers fuel from the tank through the inlet, the common space, and into the outlet and returns fuel through the return port into the common space and back to the inlet while allowing the vent to equalize pressures through the body and the tank.

From the aforementioned description, a fuel return block has been described. The fuel return block is uniquely capable of providing a fitting that connects lines and simultaneously delivers fuel, returns fuel, and equalizes pressures. The fuel return block has an intersecting inlet, outlet, and return port each of a different diameter or geometry that meet in a common space inside a body that accommodates fuel and air flow while equalizing pressure. The fuel return block and its various components may be manufactured from many materials, including but not limited to, brass, bronze, steel, aluminum, polymers, polyvinyl chloride, high density polyethylene, polypropylene, ferrous and non-ferrous metals, their alloys, and composites.

As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

I claim:

1. A fitting that equalizes pressure between fuel flows through an opening in a fuel tank, comprising:

a body, generally elongated, having a length, a longitudinal axis, and two opposite ends including a first end and a second end;

an inlet proximate said first end and perpendicular to said length;

an outlet opposite said inlet and coaxial with said inlet, said inlet and said outlet mutually communicating through said body;

a return port proximate said first end, said return port being coaxial with the longitudinal axis of said body, said return port intersecting said inlet and said outlet in a common space; and, a vent communicating with said return port, said vent positioning opposite said inlet proximate said second end;

wherein said inlet is adapted to secure to one opening of a tank, said fitting allows for withdrawal of fuel from the tank through said inlet and then said outlet, said fitting allows for return of fuel to the tank through said return port and said inlet, and said fitting dissipates any pressure imbalances through said vent.

2. The pressure equalizing fitting of claim 1 further comprising:

said outlet having an inside diameter;

said inlet having an inside diameter exceeding the inside diameter of said outlet; and, said return port having a hollow frusto conical shape oriented interiorly of said body.

3. The pressure equalizing fitting of claim 1 further comprising:

said common space communicating to a tube opposite said first end, said tube generally centering upon said return port and said tube communicating through said body into said vent.

4. The pressure equalizing fitting of claim 1 further comprising:

said vent having a hollow frusto conical shape generally perpendicular to said body, said vent positioning proximate said inlet; and, said return port terminating in a tube opposite said first end, said tube communicating through said body into said vent.

5. A device balancing pressure between a fuel tank, a fuel line, a return fuel line, and the atmosphere through a common opening in the fuel tank with minimal release of fuel vapors to the atmosphere, said device comprising:

a body, generally elongated, having a length, a longitudinal axis, and two opposite ends including a first end and a second end;

a hollow return port proximate said first end, said return port being coaxial with the longitudinal axis of said body and having a frusto conical shape extending into said body;

a hollow tube coaxial with said return port and extending away from said return port away from said first end, said tube having a lesser diameter than said return port;

a hollow vent communicating with said tube, said vent being generally perpendicular to the longitudinal axis of said body and having a frusto conical shape extending into said body;

said vent positioning proximate said second end away from said return port and having a base positioning generally below said tube wherein any fuel exiting said tube collects;

an inlet proximate said first end toward said return port and perpendicular to said length, said inlet extending into said body and intersecting with said return port;

an outlet opposite said inlet and coaxial with said inlet, said outlet extending into said body and intersecting with said return port wherein said inlet and said outlet mutually communicate through said body; and, a common space forming from the intersection of said inlet, said outlet, and said return port;

wherein said inlet is adapted to secure to the common opening of the fuel tank and wherein said device allows for simultaneous withdrawal and return of fuel to the fuel tank and dissipation of any pressure imbalances.

6. The pressure balancing device in a common opening of claim 5 further comprising:

said inlet extending outwardly from said body; and, said outlet extending outwardly from said body.

7. The pressure balancing device in a common opening of claim 5 further comprising:

said inlet extending outwardly from said body; and, said outlet being a threaded recessed aperture.

8. The pressure balancing device in a common opening of claim 5 further comprising:

said inlet having a chamber therein for passage of fuel, said chamber having an inside diameter; and, said outlet having a chamber therein for passage of fuel, said chamber having an inside diameter.

9. The pressure balancing device in a common opening of claim 8 further comprising:

said chamber of said inlet and said chamber of said outlet having different inside diameters.

10. The pressure balancing device in a common opening of claim 9 further comprising:

said chamber of said outlet having a lesser inside diameter than said chamber of said inlet.

11. The pressure balancing device in a common opening of claim 8 further comprising:

said chamber of said inlet and said chamber of said outlet having similar inside diameters.

12. A fitting equalizing pressure between fuel inflow, fuel outflow, and the atmosphere through a common opening in a fuel tank with minimal release of fuel vapors, comprising:

a body, generally elongated, having a length, a longitudinal axis, and two opposite ends;

an inlet proximate one end and perpendicular to said length;

an outlet coaxial with said inlet and opposite said inlet, said inlet and said outlet mutually communicating through said body;

a return port proximate said one end, said return port being coaxial with the longitudinal axis of said body;

a common space in the intersection of said return port, said inlet and said outlet;

a hollow tube coaxial with said return port and extending away from said common space opposite said return port, said tube having a lesser diameter than said return port;

a vent communicating with said tube, said vent being generally perpendicular to the longitudinal axis of said body and having a frusto conical shape extending into said body, and said vent positioning opposite said inlet proximate the other of said ends; and, wherein said inlet is adapted to secure to the common opening of the fuel tank, said fitting is adapted to withdraw fuel from the tank through said inlet and then said outlet, said fitting is adapted to return fuel to the tank through said return port and said inlet, and said fitting dissipates any pressure imbalances therein through said vent.

* * * * *